US009383150B2

(12) United States Patent
Lim

(10) Patent No.: US 9,383,150 B2
(45) Date of Patent: Jul. 5, 2016

(54) CHARGE FEEDING APPARATUS

(71) Applicant: HANWHA TECHWIN CO.,LTD., Changwon-Si (KR)

(72) Inventor: Jinkook Lim, Changwon-si (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 0 days.

(21) Appl. No.: 14/678,133

(22) Filed: Apr. 3, 2015

(65) Prior Publication Data

US 2016/0116238 A1 Apr. 28, 2016

(30) Foreign Application Priority Data

Oct. 28, 2014 (KR) ..... 10-2014-0147619

(51) Int. Cl.
*F41A 9/49* (2006.01)
*F41A 9/76* (2006.01)
*F41A 9/37* (2006.01)

(52) U.S. Cl.
CPC ... *F41A 9/49* (2013.01); *F41A 9/76* (2013.01); *F41A 9/375* (2013.01)

(58) Field of Classification Search
CPC ..... F41A 9/38–9/51; F41A 9/375
USPC ..... 89/45–47
See application file for complete search history.

(56) References Cited

U.S. PATENT DOCUMENTS 4,457,209 A * 7/1984 Scheurich ..... F41A 9/14 89/34
5,111,730 A * 5/1992 Grabner ..... F41A 9/22 89/45
5,151,556 A * 9/1992 Maher ..... F41A 9/76 198/803.13
5,170,006 A * 12/1992 Maher ..... F41A 9/76 89/33.16
5,196,643 A 3/1993 Jorg et al.
5,458,044 A * 10/1995 Delbos ..... F41A 9/01 89/33.1
5,773,747 A 6/1998 Tellander et al.
5,831,201 A * 11/1998 Andersson ..... F41A 9/42 89/45
5,837,923 A * 11/1998 Gay ..... F41A 9/09 89/45
5,844,163 A * 12/1998 Lindskog ..... F41A 9/375 89/46
6,048,159 A * 4/2000 Nicolas ..... F41A 9/20 294/104
6,065,385 A * 5/2000 Steward ..... F41A 9/76 198/803.8
6,205,904 B1 * 3/2001 Boutet ..... F41A 9/21 89/33.1
6,481,328 B1 * 11/2002 Hallqvist ..... F41A 9/10 89/46
7,475,626 B2 * 1/2009 Grunewald ..... F41A 9/14 89/35.01
8,596,184 B2 * 12/2013 Lindskog ..... F41A 9/375 89/1.4
2006/0162541 A1 7/2006 Heldmann et al.

FOREIGN PATENT DOCUMENTS

KR 10-2012-0098726 A 9/2012

* cited by examiner

*Primary Examiner* — Troy Chambers
*Assistant Examiner* — Joshua Semick
(74) *Attorney, Agent, or Firm* — Sughrue Mion, PLLC

(57) ABSTRACT

Provided is a charge feeding apparatus including: a plurality of containers storing a plurality of charges; a chain link configured to connect the containers extending in a first direction and arranged in parallel to one another and configured to rotatably change positions of the containers; a chain driver configured to transmit a rotational force to the chain link to transfer a container of the containers to a discharge position; a rod configured to transfer at least one charge of the charges in the first direction of the container to discharge the at least one charge from the container located at the discharge position; a loading container configured to store the at least one charge discharged from the container located at the discharge position and comprising an opening which exposes the charge; and an extractor configured to extract the charge from the loading container via the opening.

19 Claims, 7 Drawing Sheets

CHARGE FEEDING APPARATUS

CROSS-REFERENCE TO RELATED APPLICATION

This application claims priority from Korean Patent Application No. 10-2014-0147619, filed on Oct. 28, 2014, in the Korean Intellectual Property Office, the disclosure of which is incorporated herein by reference in its entirety.

BACKGROUND

1. Field

Apparatuses consistent with exemplary embodiments relate to a charge feeding apparatus, and more particularly, to a charge feeding apparatus which may quickly feed a charge in order to support automatic fire of a vehicle-mounted self-propelled gun.

2. Description of the Related Art

In modern wars, a self-propelled gun is used as an essential piece of combat equipment to fire projectiles at a target. Shells are loaded on the self-propelled gun, and the self-propelled gun can be moved at high speed between military camps. Each shell is combined with a charge at the rear end thereof and is fired due to an explosive force generated by ignition of the charge in a gun barrel. Thus, charge feeding needs to be quickly performed in order to smoothly perform automatic fire with the self-propelled gun.

In the related art, because a charge loading and transferring process is performed semi-automatically or manually, human operation is unavoidable and considerable time is taken to feed a self-propelled gun with charges.

In particular, in the case of transferring charges loaded vertically in a charge rack, charges that are not extracted at one time are left in the charge rack. Accordingly, it is difficult to remove residual charges by a separate human operation.

SUMMARY

One or more exemplary embodiments include charge feeding apparatuses that may quickly transfer a charge to a firing position without any residual charges.

Additional aspects will be set forth in part in the description which follows and, in part, will be apparent from the description, or may be learned by practice of the presented exemplary embodiments.

According to an aspect to an exemplary embodiment, there is provided a charge feeding apparatus including: a plurality of containers each configured to store a plurality of charges; a chain link configured to connect the containers disposed in a horizontal direction in parallel to each other and rotate to change positions of the containers; a chain driver configured to transmit a rotational force to the chain link to transfer one of the containers to a discharge position; a transferring unit configured to transfer the charges in a lengthwise direction of the container to discharge the charges from the container located at the discharge position; a loading container configured to store the charges discharged from the container located at the discharge position, and including an opening that exposes at least some of the charges to the outside of the loading container; and an extractor configured to extract the charges from the loading container via the opening.

The container may have a sectional shape corresponding to at least a portion of a sectional shape of the charge to guide a movement of the charge, and both end portions of the container may be opened to the outside thereof.

The charges may be aligned in the container to move in the lengthwise direction of the container while the charges are in contact with each other.

The chain link may rotate in a direction intersecting the lengthwise direction of the container.

The chain driver may include a sprocket engaged with the chain link to transmit the rotational force to the chain link.

The containers may be respectively disposed in spaces between sawteeth of the sprocket such that the chain link and the sprocket may rotate while being engaged with each other.

The transferring unit may include a rod inserted into the container to move in the lengthwise direction of the container while pressing the charges.

The transferring unit may discharge the charges sequentially from the charge located at the other end portion of the container.

The loading container may extend in a vertical direction to load the charges discharged from the container in the vertical direction.

A portion of the loading container may be curved to connect the loading container to the container transferred to the discharge position.

The opening of the loading container may have a length along which more than one of the charges are exposed to the outside.

The loading container may support the charges exposed to the outside through the opening.

The extractor may extract more than one of the charges at one time from the opening of the loading container simultaneously.

The extractor may include grippers configured to grip the charges supported by the loading container.

The charge feeding apparatus may further include a controller configured to control a movement distance of the rod from the discharge position in the lengthwise direction of the container.

The controller may include: a signal control processor configured to receive information about the number of the charges stored in the container located at the discharge position and generate a control signal according to the information about the number of the charges; and a rod driver configured to receive the control signal and move the rod according to the control signal.

The charge feeding apparatus may further include a sensor configured to detect and extracted number of the charges extracted through the opening of the loading container.

The signal control processor may calculate a target number of charges to be discharged to the loading container on the basis of the extracted number of charges extracted through the opening of the loading container, and generate the control signal according to the target number of the charges.

When the rod moves according to the control signal, as many charges as the target number of the charges may be discharged from the container and the loading container may be filled with the discharged charges.

When the charges in the container located at the discharge position are exhausted, the subsequent container may be transferred to the discharge position.

According to an aspect to another exemplary embodiment, there is provided a charge feeding apparatus including: a plurality of containers, each of the plurality of containers configured to store a plurality of charges; a chain link configured to connect the plurality of containers extending in a first direction and arranged in parallel to one another and configured to rotatably change positions of the plurality of containers; a chain driver configured to transmit a rotational force to the chain link to transfer a container of the plurality of containers to a discharge position; a rod configured to transfer at least one charge of the plurality of charges in the first direction of the container to discharge the at least one charge from the container located at the discharge position; a loading container configured to store the at least one charge discharged from the container located at the discharge position and including an opening which exposes the at least one charge; and an extractor configured to extract the at least one charge from the loading container via the opening.

The container may include a cross-sectional shape corresponding to at least a portion of a cross-sectional shape of each charge to guide a movement of each charge, and opposite end portions of the container are opened to the outside thereof.

The plurality of charges may be aligned in the container to move in the first direction and the plurality of charges are in contact with one another.

The chain link may rotate in a direction intersecting the first direction.

The chain driver may include a sprocket engaged with the chain link to transmit the rotational force to the chain link.

The plurality of containers may be respectively disposed in spaces between sawteeth of the sprocket, and the chain link and the sprocket may be configured to rotate while being engaged with each other.

The rod may be inserted into the container to move in the first direction from a first end portion of the container to a second end portion opposite to the first end portion of the container.

The rod may be configured to discharge the at least one charge sequentially starting from a charge located at the second end portion of the container.

The loading container may extend in a second direction perpendicular to the first direction to load the at least one charge discharged from the container in the second direction.

The loading container may include a curved portion configured to connect the loading container to the container transferred to the discharge position.

The opening of the loading container may expose at least two charges of the plurality of charges.

The loading container may be configured to support the charges exposed through the opening.

The extractor may be configured to extract at least two of the plurality of charges at one time from the loading container via the opening.

The extractor may include grippers configured to grip the at least two of the plurality of charges supported by the loading container.

The charge feeding apparatus may further include a controller configured to control a movement distance of the rod in the first direction.

The controller may include: a signal control processor configured to receive information about a number of stored charges stored in the container located at the discharge position and generate a control signal according to the information about the number of stored charges; and a rod driver configured to receive the control signal and move the rod according to the control signal.

The charge feeding apparatus may further include a sensor configured to detect a number of extracted charges extracted through the opening of the loading container.

The signal control processor may be configured to calculate a target number of charges to be discharged to the loading container on the basis of a number of extracted charges extracted through the opening of the loading container, and is configured to generate the control signal according to the target number of the charges.

When the rod moves according to the control signal, the target number of charges corresponding to the number of extracted charges may be discharged from the container and are filled in the loading container.

When the plurality of charges in the container located at the discharge position are exhausted, a subsequent container of the plurality of the containers may be transferred to the discharge position.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
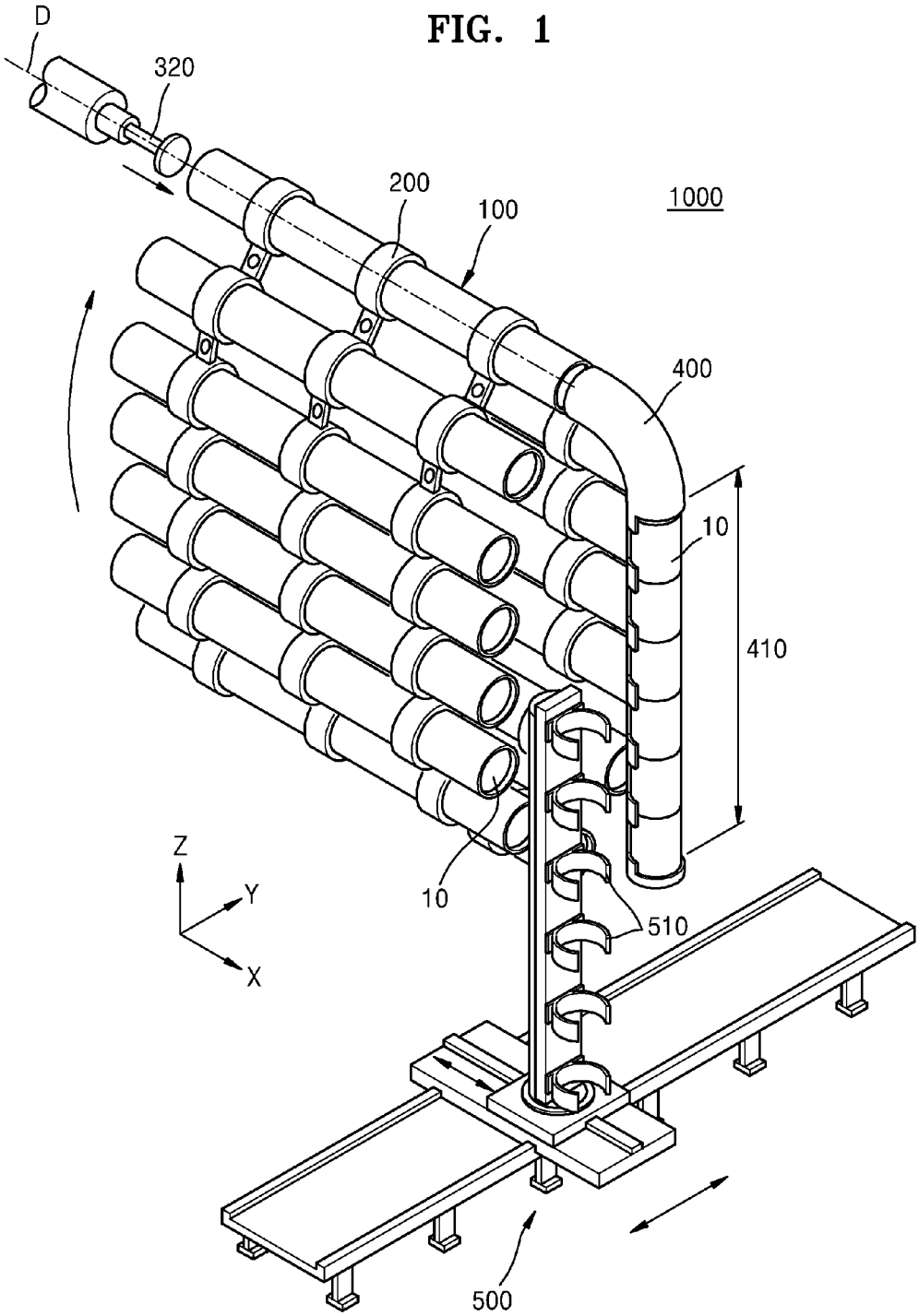
FIG. 1 is a schematic perspective view of a charge feeding apparatus according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

The inventive concept will be apparent from the exemplary embodiments described below in detail with reference to the accompanying drawings. The inventive concept may, however, be embodied in many different forms and should not be construed as being limited to the exemplary embodiments set forth herein; rather, these exemplary embodiments are provided so that this disclosure will be thorough and complete, and will fully convey the inventive concept to those of ordinary skill in the art. Therefore, the scope of the inventive concept is defined not by the detailed description of the exemplary embodiments but by the appended claims. The terminology used herein is for the purpose of describing the exemplary embodiments only and is not intended to be limiting of the exemplary embodiments. As used herein, the singular forms "a," "an" and "the" are intended to include the plural forms as well, unless the context clearly indicates otherwise. It will be understood that the terms "comprise" and "comprising" used herein specify the presence of stated elements, steps, operations, or devices, but do not preclude the presence or addition of one or more other elements, steps, operations, or devices. Although terms such as "first" and "second" may be used herein to describe various elements or components, these elements or components should not be limited by these terms. These terms are only used to distinguish one element or component from another element or component.

FIG. 1 is a schematic perspective view of a charge feeding apparatus 1000 according to an exemplary embodiment.

Figure 2:
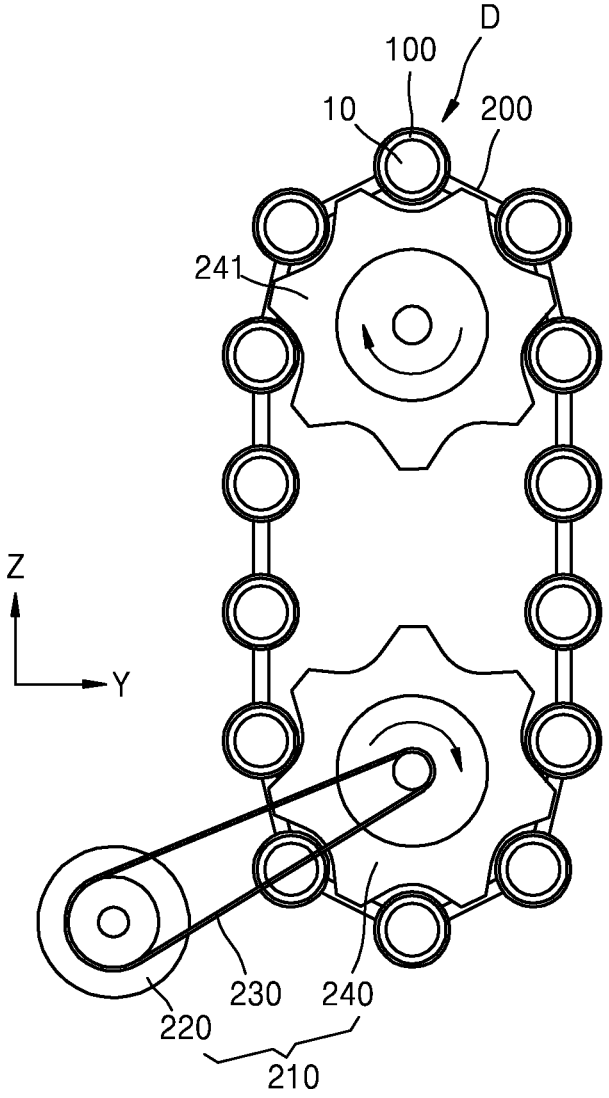
FIG. 2 is a schematic cross-sectional view of the charge feeding apparatus of FIG. 1 taken in an X direction according to an exemplary embodiment.

FIG. 2 is a schematic cross-sectional view of the charge feeding apparatus 1000 of FIG. 1 taken in an X direction according to an exemplary embodiment.

Referring to FIGS. 1 and 2, the charge feeding apparatus 1000 includes a plurality of containers 100 where each of the plurality of containers is configured to store a plurality of charges 10, a chain link 200 configured to connect the containers 100, a chain driver 210 configured to transmit a rotational force to the chain link 200, a transferring unit 300 configured to transfer the charges 100 in a lengthwise direction of the container 100 to discharge the charges 10 from the container 100, a loading container 400 configured to store the charges 10 discharged from the container 100, and an extractor 500 configured to extract the charges 10 from an opening 410 of the loading container 400.

Figure 3:
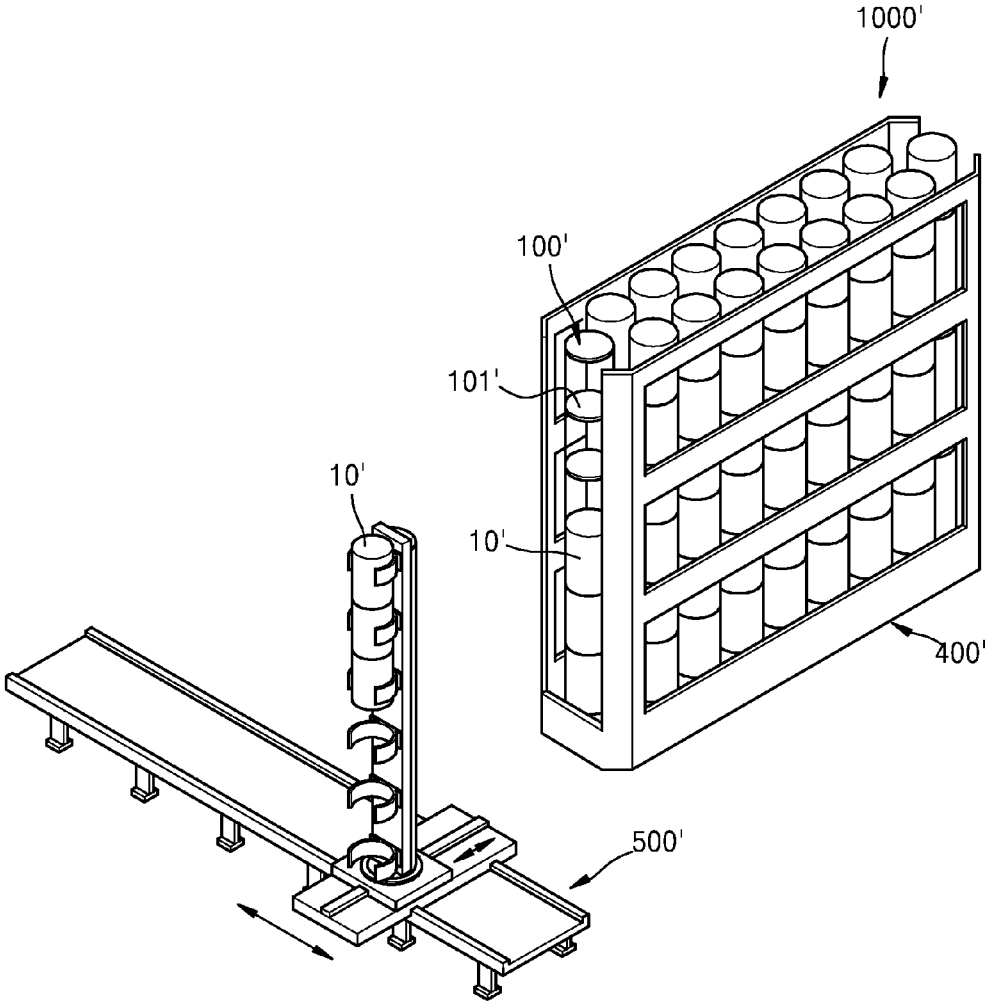
FIG. 3 illustrates a comparative example of a charge feeding apparatus of the related art.

FIG. 3 illustrates a comparative example of a charge feeding apparatus 1000' of the related art.

As illustrated in FIG. 3, the charge feeding apparatus 1000' of the related art as the comparative example may include a charge rack 400' and an extractor 500' configured to extract charges from the charge rack 400'. In the charge rack 400' of the charge feeding apparatus 1000' of the related art, a plurality of containers 100' are arranged in a vertical direction, and six charges are stored in each of the containers 100' while being divided by partitions 101'. For example, when charges 10' are transferred to a firing position, between three to six charges 10' may be simultaneously extracted at one time, i.e., one extraction operation of the extractor 500, from the container 100'. If three charges 10' (i.e., the top three charges 10') are extracted from the container 100' at once, three residual charges 10' (i.e., the bottom three charges 10'), which are not extracted from the container 100', are left in the container 100'. Thereafter, if six charges 10' are to be extracted, the extractor 500' has no choice but to move to another container 100' and simultaneously extract three charges 10' from the other container 100' without extracting the three residual charges 10' from the container 100'. Thus, when this extracting process is repeated, residual charges 10' are left in each container 100'. These residual charges are to be removed by a separate human operation.

As described above, when residual charges 10' left in the charge rack 400' are separately processed, unnecessary time is required to transfer the charges 10' to the firing position and a separate human operation is required to remove the residual charges 10'. This problem hampers the automation and delays speedup of self-propelled gun firing.

Hereinafter, the configurations and operations of the charge feeding apparatus 1000 according to an exemplary embodiment will be described in comparison with the comparative example 1000' of FIG. 3.

Referring to FIG. 1, the container 100 stores a charge. The container 100 may store a plurality of charges 10. Although the container 100 of FIG. 1 is illustrated as storing six charges 10 like the container 100' of FIG. 3, exemplary embodiments are not limited thereto. For example, the container 100 may contain more than six charges or the container 100 may contain less than six charges.

The charge 10 stored in the container 100 is transferred by the transferring unit 300 (FIG. 4) in the lengthwise direction of the container 100, that is, the X direction. The sectional shape of the container 100 may correspond to the sectional shape of the charge 10 in order to easily guide the movement of the charge 10. In this regard, the sectional shape of the container 100 may not exactly correspond to the sectional shape of the charge 10 in order to easily guide the movement of the charge 10. For example, the container 100 may have a sectional shape (e.g., a semicircular shape) corresponding to at least a portion of the sectional shape of the charge 10. That is, the shape of the container 100 may be cylindrical or partially cylindrical.

Also, the charges 10 are aligned in the container 100 to move in the lengthwise direction (i.e., the X direction) of the container 100 while contacting each other. In this case, in order to induce the contact between the adjacent charges, the container 100 may not beed the partitions 101' dividing the charges 10' unlike the container 100' of the related art as shown in FIG. 3.

Both end portions of the container 100 may be opened to an outside thereof. That is, one end portion of the container 100 may be opened to the outside so that a rod 320 of the transferring unit 300 may be inserted into the container 100 through the one end portion of the container 100. Also, the other end portion of the container 100 may be opened to the outside in order to discharge the charge 10 at a discharge position D.

The container 100' of FIG. 3 stands in the vertical direction (i.e., along the Z-axis), whereas the container 100 in an exemplary embodiment is disposed in the horizontal direction (i.e., along the X-axis) as illustrated in FIG. 1. That is, the containers 100 are disposed in the horizontal direction in parallel to each other. Herein, the horizontal direction corresponds to the X direction, and the vertical direction corresponds to a Z direction.

The chain link 200 connects the containers 100 disposed in the horizontal direction and in parallel to one another. Because the containers 100 arranged in the horizontal direction and in parallel to one another are connected by the chain link 200, the charges 10 in the container 100 may also be disposed in the horizontal direction. That is, by the chain link 200, the disposition of the charges 10 is converted from a vertical mode to a horizontal mode.

Since the charges 10' in FIG. 3 are disposed in the vertical direction, the charges 10' are in danger of falling and exploding. On the other hand, since the charges 10 disposed in the horizontal direction are in less danger of falling than the charges 10', the charges 10 may be more safely stored than the charges 10'. Also, as illustrated in FIG. 2, because a link element constituting the chain link 200 is interposed between the adjacent containers 100, the containers 100 may be spaced apart from each other and thus the charges 10 may be more safely stored.

Referring to FIG. 2, the chain link 200 may rotate in a direction intersecting the lengthwise direction (i.e., X direction) of the container 100. That is, a rotational path of the chain link 200 may be formed on a Y-Z plane intersecting the X direction. When the chain link 200 rotates, the position of the container 100 also changes along the rotational path of the chain link 200.

The chain driver 210 transmits a rotational force to the chain link 200. As an example, chain-sprocket driving may be used to transmit the rotational force. Referring to FIG. 2, the chain driver 210 includes a sprocket 240 that is engaged with the chain link 200 to transmit a rotational force to the chain link 200. A method of transmitting a rotational force to the chain link 200 by the sprocket 240 will be described below in detail.

As illustrated in FIG. 2, the sprocket 240 is driven by a driving motor 220. The driving motor 220 may transmit a rotational force to the sprocket 240 through a belt 230. However, exemplary embodiments are not limited to a driving method based on the belt 230. For example, exemplary embodiments may also include a driving method in which a hydraulic motor is directly connected to the axis of the sprocket 240.

The containers 100 may be respectively disposed in the spaces between sawteeth of the sprocket 240. Accordingly, when the sprocket 240 is rotated by the driving motor 220, the chain link 200 also rotates by engaging with the sprocket 240. As illustrated in FIG. 2, a driven sprocket wheel 241 is disposed at a portion of the chain link 200 spaced apart from the sprocket 240 and is engaged with the chain link 200 to assist the chain link 200 to rotate smoothly. Herein, a pinion or a cylinder may be disposed instead of the driven sprocket wheel 241.

When the chain link 200 rotates, one of the containers 100 is transferred to the discharge position D. Referring to FIGS. 1 and 2, the discharge position D is located at a top portion in the vertical direction (i.e., the Z direction), and the container 100 is connected to the loading container 400 at the discharge position D. However, the discharge position D is not limited thereto. For example, the discharge position D may be located at an intermediate position or a bottom position depending on the self-propelled gun.

Figure 4:
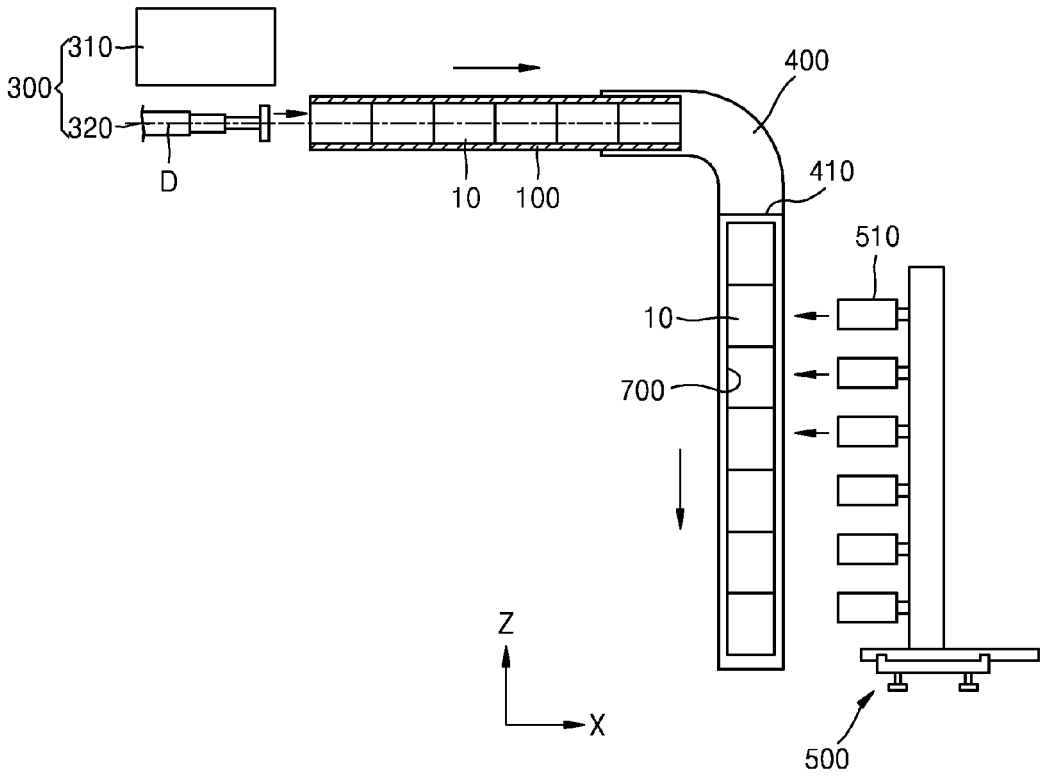
FIG. 4 is a schematic cross-sectional view of the charge feeding apparatus of FIG. 1 taken in a Y direction according to an exemplary embodiment.

FIG. 4 is a schematic cross-sectional view of the charge feeding apparatus 1000 of FIG. 1 taken in a Y direction.

Referring to FIG. 4, the transferring unit 300 is configured to discharge the charges 10 from the container 100 located at the discharge position D. In order to discharge the charges 10, the transferring unit 300 includes the rod 320 acting as a pressing unit.

Specifically, the rod 320 is inserted into the container 100 from one end portion of the container 100. As described above, one end portion of the container 100 is opened to the outside so that the rod 320 may be inserted into the container 100.

The rod 320 moves in the lengthwise direction (i.e., the X direction) of the container 100 while pressing the charges 10 stored in the container 100. Accordingly, the charges 10 also move in the X direction together with the rod 320. As described above, in order to guide the movement of the charges 10, the sectional shape of the container 100 corresponds to the sectional shape of the charge 10.

The rod 320 may have any sectional shape such as a circular sectional shape or a polygonal sectional shape, but the end portion of the rod 320 contacting the charge 10 may be flat.

Figure 5:
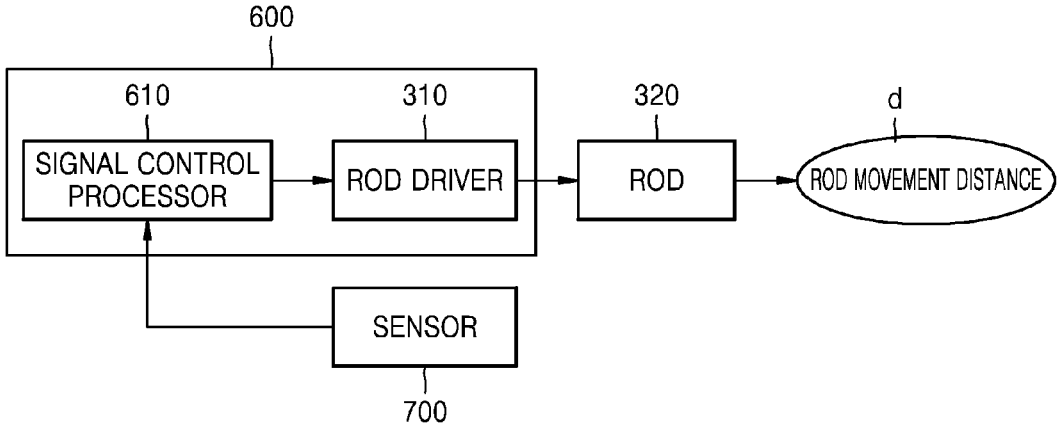
FIG. 5 is a control block diagram of the charge feeding apparatus of FIG. 1 according to an exemplary embodiment.

As the rod 320 presses the charge 10 at one end portion of the container 100, the charge 10 at the other end portion of the container 100 is discharged outside the container 100. That is, the transferring unit 300 is configured to discharge the charges 10 sequentially from the charge 10 located at the other end portion opposite to one end portion at which the rod 320 contacts the charge 10. In this case, a rod movement distance d and the number of discharged charges 10 are controlled by a controller 600 as shown in FIG. 5.

As described above, the charges 100 discharged from the container 100 located at the discharge position D are stored in the loading container 400.

Referring to FIGS. 1 and 4, the loading container 400 extends in the Z direction and stores the charges 10 discharged from the container 100 in the vertical direction (i.e., the Z direction).

A portion of the loading container 400 may be curved to connect the loading container 400 to the container 100 transferred to the discharge position D. That is, the loading container 400 is configured to vertically load the charges 10 disposed horizontally in the container 100 so that the extractor 500 may easily extract the charges 10.

Also, the loading container 400 includes the opening 410 configured to expose at least some of the charges 10 to the outside thereof. The opening 410 has a length along which the charges 10 are exposed to the outside. Herein, the number of charges 10 exposed to the outside may be equal to the number of grippers 510 of an extractor 500.

The loading container 400 supports the charges 10 exposed to the outside through the opening 410. Thus, the residual charges 10, which are not extracted through the opening 410, may be prevented from falling when some of the exposed charges 10 are extracted by the extractor 500.

The extractor 500 extracts the charges 10 from the opening 410 of the loading container 400.

Referring to FIGS. 1 and 4, the extractor 500 may extract the charges 10 from the opening 410 of the loading container 400 simultaneously.

The extractor 500 may include the grippers 510 configured to grip the charges 10 supported by the loading container 400. The grippers 510 may, for example, extract three (3) to six (6) charges 10 independently from the opening 410 of the loading container 400.

FIG. 5 is a control block diagram of the charge feeding apparatus 1000 of FIG. 1 according to an exemplary embodiment.

Referring to FIGS. 4 and 5, the charge feeding apparatus 1000 according to an exemplary embodiment may further include the controller 600 configured to control a distance of the movement of the rod 320 from the discharge position D in the lengthwise direction (i.e., the X direction) of the container 100.

The controller 600 includes a signal control processor 610 and a rod driver 310.

The signal control processor 610 receives information about a stored number of charges 10 which are stored in the container 100 and generates a control signal according to the information about the stored number of charges 10.

The rod driver 310 receives the control signal and moves the rod 320 according to the control signal. The rod driver 310 moves the rod 320 along the discharge position D in the lengthwise direction of the container 100. The rod driver 310 may be any type that enables the linear movement of the rod 320. For example, the rod 320 may be linearly driven by a linear motor or a rotary motor including a lead screw.

Also, according to the control block diagram of FIG. 5, the charge feeding apparatus 1000 may further include a sensor 700 configured to detect an extracted number of charges 10 extracted through the opening 410 of the loading container 400.

A process of calculating a target number of charges 10 that should be discharged to the loading container 400 by controlling the rod movement distance d will be described below in detail.

Figure 6A:
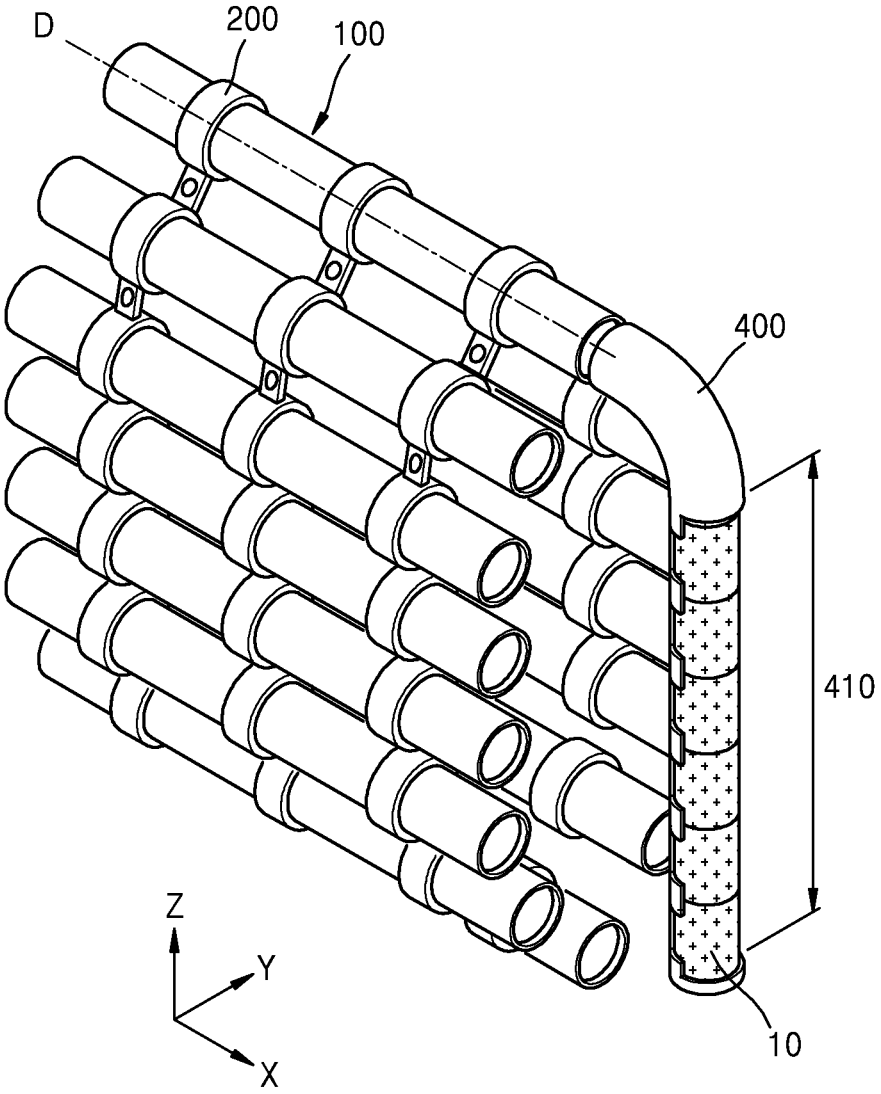
FIGS. 6A to 6C are perspective views illustrating a sequential process of extracting charges from the charge feeding apparatus of FIG. 1 according to an exemplary embodiment.
Figure 6B:
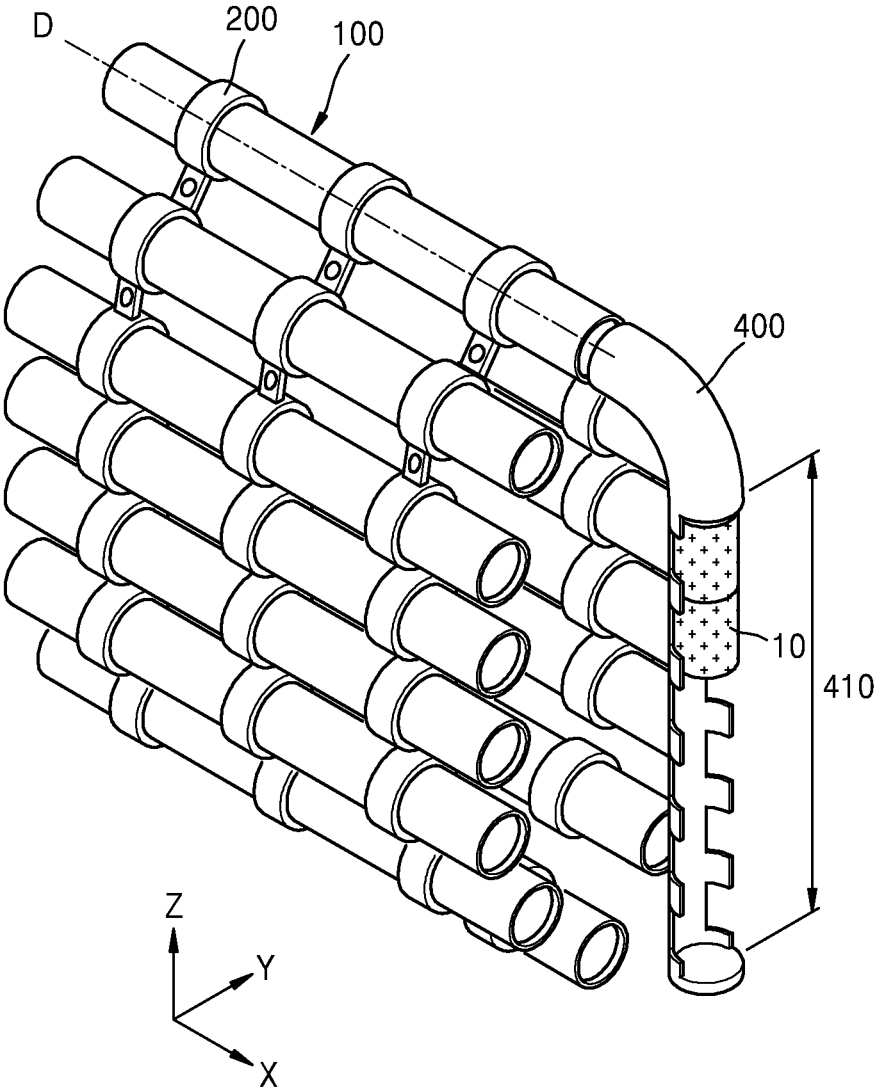
Figure 6C:
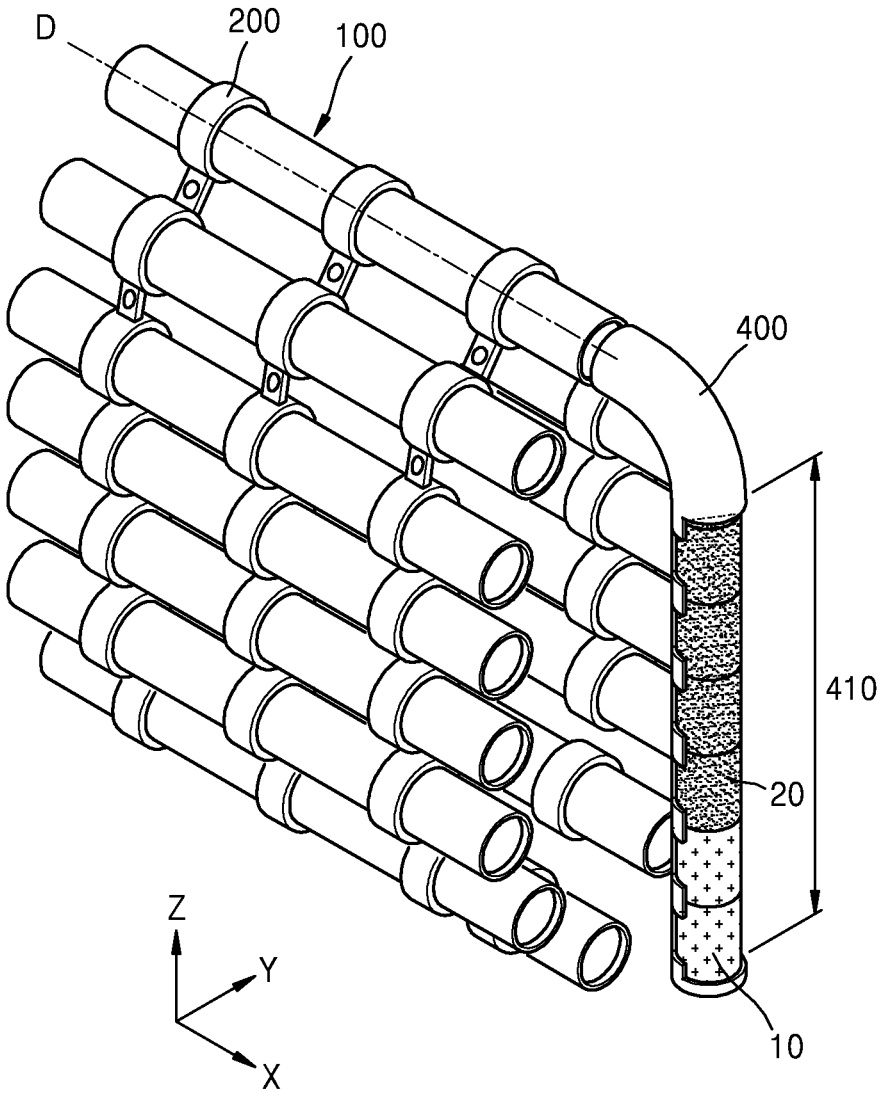

FIGS. 6A to 6C are perspective views illustrating a sequential process of extracting charges from the charge feeding apparatus 1000 of FIG. 1.

Referring to FIGS. 5 and 6A to 6C, the signal control processor 610 calculates the target number of charges 20 that should be discharged to the loading container 400 on the basis of the extracted number of charges detected from the sensor 700, and generates the control signal according to the number of the target charges 20. As a simple example, the extracted number of the charges may be equal to the target number of the charges 20.

The signal control processor 610 provides the control signal to the rod driver 310 to control a driving force applied to the rod 320. As an example, current value of the motor driving the rod 320 may be controlled according to the generated control signal.

As described above, when the rod 320 is moved by the controlled driving force in the lengthwise direction (i.e., the X direction) of the container 100, as many charges 10 as the target number of the charges 20 are discharged from the container 100 and the loading container 400 is filled with the discharged charges 10.

In this case, when the charges 10 in the container 100 located at the discharge position D are exhausted or depleted, a subsequent container 100 is rotatably transferred to the discharge position D. Accordingly, the rod 320 is inserted into the subsequent container 100 and is moved to discharge the charges 10 until the target number of the charges 20 is satisfied.

Based on the illustration of FIGS. 6A to 6C, the above descriptions are summarized as follows: For convenience of description, it is assumed that the stored number of charges stored in the container 100 is six (6) as illustrated in FIGS. 1 and 3.

As illustrated in FIG. 6A, is it assumed that six charges 10 discharged from the container 100 located at the discharge position D fill the entire length of the opening 410 of the loading container 400.

Thereafter, as illustrated in FIG. 6B, when four (4) charges 10 are extracted, two residual charges 10 are left at the top side of the opening 410 and then fall to the bottom side of the opening 410. However, unlike in the above method, as illustrated in FIG. 4, the upper grippers 510 of the extractor 500 may extract the charges 10 sequentially from the charge 10 located at the top of the opening 410. In this case, the two residual charges 10 are left at the bottom side of the opening 410 without any movement.

Referring to FIG. 6C, as many target number of charges 20 as the extracted number of the extracted four (4) charges 10 are loaded sequentially from the top side of the opening 410. Accordingly, the space of the loading container 400, in which the opening 410 is formed, is always filled with the charges 10.

Thus, even when any number (among three to six) of charges 10 are extracted, the problem of leaving the residual charges 10 as in the comparative example 1000' of FIG. 3 does not occur. Also, since the trouble of removing the residual charges 10 by a separate human operation is removed, overall automation may be promoted in feeding the charges 10 to the self-propelled gun.

As described above, according to the one or more of the above exemplary embodiments, the charge feeding apparatus may transfer the charge to the firing position without any residual charges.

Also, the charge feeding apparatus may quickly transfer the charge to the firing position by automating charge extraction.

Also, the charge feeding apparatus may reduce the charge explosion risk by safely storing the charge in the horizontal direction.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A charge feeding apparatus comprising:

a plurality of containers, each of the plurality of containers configured to store a plurality of charges;

a chain link configured to connect the plurality of containers extending in a first direction and arranged in parallel to one another and configured to rotatably change positions of the plurality of containers;

a chain driver configured to transmit a rotational force to the chain link to transfer a container of the plurality of containers to a discharge position;

a rod configured to transfer at least one charge of the plurality of charges in the first direction of the container by pushing the at least one charge in order to discharge the at least one charge from the container located at the discharge position;

a loading container configured to store the at least one charge discharged from the container located at the discharge position, extending in a second direction crossing the first direction, and comprising an opening which exposes the at least one charge; and an extractor configured to extract the at least one charge from the loading container via the opening, wherein when the rod pushes the at least one charge, the at least one charge moves along the first direction in the container, moves along second direction in the loading container, and is loaded in the loading container, and wherein the loading container comprises a curved portion configured to bend a path of the at least one charge from the first direction to the second direction, the curved portion provided between the container and the opening of the loading container.

2. The charge feeding apparatus of claim 1, wherein the container comprises a cross-sectional shape corresponding to at least a portion of a cross-sectional shape of each charge to guide a movement of each charge, and opposite end portions of the container are opened to the outside thereof.

3. The charge feeding apparatus of claim 1, wherein the plurality of charges are aligned in the container to move in the first direction and the plurality of charges are in contact with one another.

4. The charge feeding apparatus of claim 1, wherein the chain link rotates in a direction intersecting the first direction.

5. The charge feeding apparatus of claim 1, wherein the chain driver comprises a sprocket engaged with the chain link to transmit the rotational force to the chain link.

6. The charge feeding apparatus of claim 5, wherein the plurality of containers are respectively disposed in spaces between sawteeth of the sprocket, and wherein the chain link and the sprocket are configured to rotate while being engaged with each other.

7. The charge feeding apparatus of claim 1, wherein the rod is inserted into the container to move in the first direction from a first end portion of the container to a second end portion opposite to the first end portion of the container.

8. The charge feeding apparatus of claim 7, wherein the rod is configured to discharge the at least one charge sequentially starting from a charge located at the second end portion of the container.

9. The charge feeding apparatus of claim 1, wherein the opening of the loading container exposes at least two charges of the plurality of charges.

10. The charge feeding apparatus of claim 9, wherein the loading container is configured to support the charges exposed through the opening.

11. The charge feeding apparatus of claim 1, wherein the extractor is configured to extract at least two of the plurality of charges at one time from the loading container via the opening.

12. The charge feeding apparatus of claim 11, wherein the extractor comprises grippers configured to grip the at least two of the plurality of charges supported by the loading container.

13. The charge feeding apparatus of claim 7 further comprising a controller configured to control a movement distance of the rod in the first direction.

14. The charge feeding apparatus of claim 13, wherein the controller comprises:

a signal control processor configured to receive information about a number of stored charges stored in the container located at the discharge position and generate a control signal according to the information about the number of stored charges; and a rod driver configured to receive the control signal and move the rod according to the control signal.

15. The charge feeding apparatus of claim 11 further comprising a sensor configured to detect a number of extracted charges extracted through the opening of the loading container.

16. The charge feeding apparatus of claim 14, wherein the signal control processor is configured to calculate a target number of charges to be discharged to the loading container on the basis of a number of extracted charges extracted through the opening of the loading container, and is configured to generate the control signal according to the target number of the charges.

17. The charge feeding apparatus of claim 16, wherein when the rod moves according to the control signal, the target number of charges corresponding to the number of extracted charges are discharged from the container and are filled in the loading container.

18. The charge feeding apparatus of claim 1, wherein when the plurality of charges in the container located at the discharge position are depleted, a subsequent container of the plurality of the containers is transferred to the discharge position.

19. The charge feeding apparatus of claim 1, wherein the path of the at least one charge extends between an end portion of the container to an end portion of the loading container.

* * * * *